United States Patent [19]

Iijima et al.

[11] Patent Number: 4,583,922

[45] Date of Patent: Apr. 22, 1986

[54] SWASH PLATE TYPE COMPRESSOR IMPROVED WITH ELONGATED AND TORTUOUS INPUT AND OUTPUT PASSAGE SYSTEMS

[75] Inventors: Takeo Iijima; Mototaka Shitara; Seiji Sumikawa; Susumu Saito, all of Konan, Japan

[73] Assignee: Diesel Kiki Co., Ltd., Tokyo, Japan

[21] Appl. No.: 684,089

[22] Filed: Dec. 20, 1984

[30] Foreign Application Priority Data

Dec. 29, 1983 [JP] Japan ..... 58-199588[U]

[51] Int. Cl.[4] ..... F04B 1/18; F04B 39/12; F04B 11/00

[52] U.S. Cl. ..... 417/269; 417/312; 417/313

[58] Field of Search ..... 417/269, 312, 313

[56] References Cited

U.S. PATENT DOCUMENTS

| | | | |
|---|---|---|---|
| 3,577,891 | 5/1971 | Nemoto | 417/312 |
| 4,274,813 | 6/1981 | Kishi | 417/312 |
| 4,392,788 | 7/1983 | Nakamura | 417/269 |
| 4,407,638 | 10/1983 | Sassaya | 417/312 |

FOREIGN PATENT DOCUMENTS

| | | | |
|---|---|---|---|
| 48104 | 4/1981 | Japan | 417/312 |
| 48105 | 5/1981 | Japan | 417/312 |

*Primary Examiner*—William L. Freeh

*Attorney, Agent, or Firm*—Wenderoth, Lind & Ponack

[57] ABSTRACT

In an improved swash plate type compressor in which a first end block, holding a first valve plate against one end of the cylinder block, defines a first input plenum and an output plenum with input and output valve means for a first set of cylinder chambers, a partition plate is secured between the other end of the cylinder block and a second end block and holds a second valve plate against that end of the cylinder block, defining for a second set of cylinder chambers a second input plenum with input valve means and an output chamber with an output valve means. The second end block defines inlet and outlet buffering chambers to which an inlet and an outlet open. The cylinder block is formed with an input transfer passage communicated at its ends to the first and second input plenums. The partition plate is formed with an output transfer aperture for the output chamber, communicating it to the outlet buffering chamber. Also, a means communicates from the inlet buffering chamber to the input transfer passage. Thereby, input and output pulsations are well attenuated.

5 Claims, 5 Drawing Figures

SWASH PLATE TYPE COMPRESSOR IMPROVED WITH ELONGATED AND TORTUOUS INPUT AND OUTPUT PASSAGE SYSTEMS

BACKGROUND OF THE INVENTION

The present invention relates to a swash plate type compressor, and in particular to an improvement in a swash plate type compressor for the purpose of reduction of input and output pulsations so as to minimize noise and vibration.

In FIG. 4 of the accompanying drawings there is shown a longitudinal sectional view of a swash plate type compressor of a conventional type, and in FIG. 5 there is shown a sectional view of the compressor of FIG. 4 taken in a plane indicated by the arrows V—V in FIG. 4. The general structure of this compressor will now be explained, along with its deficiencies. For a more detailed description of the basic compressor structure, reference should be made to the section of this specification entitled "DESCRIPTION OF THE PREFERRED EMBODIMENT", which describes the structure of an improved such compressor in detail.

The reference numeral 1 denotes the body of the compressor as a whole; in the following the left hand end thereof in FIG. 4 will be referred to as its front end while its right hand end will be referred to as its rear end. The compressor body 1 is made up of two cylinder blocks 2*a*, 2*b* coaxially abutted together, two front and rear valve plates 3*a*, 3*b* at the ends of the front and rear cylinder blocks 2*a* and 2*b* respectively, a front end block 4*a* which is secured to the front end of the front cylinder block 2*a* so as to sandwich the front valve plate 3*a* thereagainst and so as to define in cooperation therewith chambers as will be explained hereinafter, and a rear end block 4*b* which is secured to the rear end of the rear cylinder block 2*b* so as to sandwich the rear valve plate 3*b* thereagainst and so as to define in cooperation therewith chambers as also will be explained hereinafter.

Rotatably mounted through the front end block 4*a*, the front valve plate 3*a*, and the front cylinder block 2*a* and in a journal formed in the rear cylinder block 2*b*, along their central axial line, there extends a shaft 6. An obliquely angled swash plate 7 is fixedly mounted on the shaft 6 at the approximate axial center of the shaft 6 between the two valve plates 3*a* and 3*b*.

Each of the cylinder blocks 2*a* and 2*b* is provided with three respective cylinder bores 10*a*, 10*b*, 10*c* and 10*d*, 10*e*, 10*f* extending parallel to its central axis and arranged around it at positions 120° apart; only one of each of these sets of cylinder bores (10*a* and 10*d*) can be seen in FIG. 1 because the other two bores of each set (10*b*, 10*c* and 10*e*, 10*f*) lie out of the sectional plane of FIG. 4. And the cylinder bores 10*a* and 10*d*, 10*b* and 10*e*, and 10*c* and 10*f* of the front and rear cylinder blocks 2*a* and 2*b* are coaxial and oppose one another.

In the cylinder bores 10*a* and 10*d* there is slidably fitted a double headed piston member 11*a*, in the cylinder bores 10*b* and 10*e* there is slidably fitted a double headed piston member 11*b*, and in the cylinder bores 10*c* and 10*f* there is slidably fitted a double headed piston member 11*c*; but only the piston member 11*a* can be seen in FIG. 4 because the other two piston members 11*b* and 11*c* lie out of its sectional plane. A front pumping chamber 14*a* is defined between the front end of the piston member 11*a* and the front valve plate 3*a*, in cooperation with the front cylinder bore 10*a*; and a rear pumping chamber 14*d* is defined between the rear end of the piston member 11*a* and the rear valve plate 3*b*, in cooperation with the rear cylinder bore 10*d*. Similarly, front pumping chambers 14*b* and 14*c* and rear pumping chambers 14*e* and 14*f* are defined by the piston members 11*b* and 11*c* and the front and rear valve plates 3*a* and 3*b*, in cooperation with the cylinder bores 10*b*, 10*c*, 10*e*, and 10*f*; but these cannot be seen in FIG. 4. The central part of the piston member 11*a* is cut away, and two balls 12*a*, 12*b* are mounted in the cutaway on opposite axial ends thereof; and via two shoe members 13*a* and 13*b* these balls 12*a* and 12*b* are engaged with the swash plate 7. The piston member 11*a* is axially reciprocated to and fro in its cylinder bores 10*a* and 10*d* as the shaft 6 and the swash plate 7 are rotated. The arrangements relating to the other two piston members 11*b* and 11*c* are similar, but cannot be seen in FIG. 4. Thus, as the shaft 6 is rotated with the swash plate 7 being thereby wobblingly rotated, the three piston members 11*a*, 11*b*, and 11*c* are reciprocally driven to and fro in their cylinder bores, with the phases of their motion differing by 120° from one another; and the six pumping chambers 14*a* through 14*f* expand and contract, with the phases of their motion differing by 60° from one another, in an arrangement which will be easily understood based upon the foregoing description.

Each of the six pumping chambers 14*a* through 14*f* is provided through its defining valve plate 3*a* or 3*b* with an input orifice, respectively denoted as 17*a* through 17*f*, and a similarly formed output orifice, respectively denoted as 19*a* through 19*f*; the input orifices 17*a* through 17*f* are on the sides of the pumping chambers 14*a* through 14*f* towards the central axis of the compressor, while the output orifices 19*a* through 19*f* are on the opposite sides of said chambers. Fluid flow through each of the output orifices 19*a* through 19*f* is controlled by a respective valve means 18*a* through 18*f*, only schematically shown in the figures, provided on the respective valve plate 3*a* or 3*b* on the outside of the respective pumping chamber 14*a* through 14*f*; this valve means 18*a* through 18*f* allows fluid to flow out of the respective pumping chamber 14*a* through 14*f* through the respective output orifice 19*a* through 19*f*, but not in the reverse direction. Similarly, fluid flow through each of the input orifices 17*a* through 17*f* is controlled by a valve means not shown in the figures; this valve means allows fluid to flow into the respective pumping chamber 14*a* through 14*f* through the respective input orifice 17*a* through 17*f*, but not in the reverse direction.

Now, the configurations of the front and the rear end blocks 4*a* and 4*b*, along with the chambers and passages defined thereby and their interconnections, will be explained. Each of these members is formed generally in a cup shape, and has a partition wall extending across it, so that in cooperation with the valve plate 3*a* or 3*b* to which it is fitted it defines two compartments: an input plenum 15*a* or 15*b*, and an output plenum 16*a* or 16*b*.

In more detail, the front end block 4*a* is formed in a manner not specifically shown in any section thereof in the figures, but generally like the rear end block 4*b* shown in section in FIG. 5 and discussed below, and is generally cup shaped, having a circular rim which is abutted against the end of the front cylinder block 2*a* and an interior partition wall which defines a front input plenum 15*a* and a front output plenum 16*a* formed in a crescent shape surrounding said front input plenum 15*a*. The front input plenum 15*a* has the three input orifices 17*a*, 17*b*, and 17*c* of the front pumping chambers 14*a*, 14*b*, and 14*c* opening through the front valve plate 3*a* into it, and also a front input transfer aperture 21*a* opens through the front valve plate 3*a* into said front input plenum 15*a*. Similarly, the front output plenum 16*a* has the three output orifices 19*a*, 19*b*, and 19*c* of the front pumping chambers 14*a*, 14*b*, and 14*c* opening through the front valve plate 3*a* into it, and also a front output transfer aperture not shown in the figures opens through the front valve plate 3*a* into said front output plenum 16*a*.

In the cylinder block 2 (i.e. the combination of the front and rear cylinder blocks 2*a* and 2*b*) between the pairs of cylinder bores 14*b*, 14*e* and 14*c*, 14*f* there is defined an input transfer chamber 22 extending right through the cylinder block 2 and communicating with the front input plenum 15*a* via the front input transfer aperture 21*a* through the front valve plate 3*a* at its front end, and, as will be seen, with the rear input plenum 15*b* via a rear input transfer aperture 21*b* through the rear valve plate 3*b* at its rear end; and similarly between the pairs of cylinder bores 14*a*, 14*d* and 14*b*, 14*e* there is defined an output transfer passage extending right through the cylinder block 2 and communicating at its front end with the front output plenum 16*a* via the aforementioned front output transfer aperture formed through the front valve plate 3*a*, and with the rear output plenum 16*b* via a rear output transfer aperture 42 through the rear valve plate 3*b* at its rear end, but none of these arrangements can be seen in the figures.

Now, referring to FIG. 5, there is shown a transverse cross section of the rear end block 4*b* looking towards the rear valve plate 3*b*. This rear end block 4*b* is generally cup shaped, having a circular rim which is abutted against the end of the rear cylinder block 2*b* and an interior partition wall which defines a rear input plenum 15*b* and a rear output plenum 16*b* formed in a crescent shape surrounding said rear input plenum 15*b*. The rear input plenum 15*b* has the three input orifices 17*d*, 17*e*, and 17*f* of the rear pumping chambers 14*d*, 14*e*, and 14*f* opening through the rear valve plate 3*b* into it, and also a rear input transfer aperture 21*b* opens through the rear valve plate 3*b* into said rear input plenum 15*b*. Similarly, the rear output plenum 16*b* has the three output orifices 19*d*, 19*e*, and 19*f* of the rear pumping chambers 14*d*, 14*e*, and 14*f* opening through the rear valve plate 3*b* into it, and also a rear output transfer aperture 42 opens through the rear valve plate 3*b* into said rear output plenum 16*b*.

Thus, the front and rear input plenums 15*a* and 15*b* are communicated together through the front input transfer aperture 21*a*, the input transfer chamber 22, and the rear input transfer aperture 21*b*; and the front and rear output plenums 16*a* and 16*b* are communicated together through the front output transfer aperture (not shown), the output transfer passage (also not shown), and the rear output transfer aperture 42. An inlet 32 is provided into the rear input plenum 15*b*, and an outlet not shown in the figures is provided out of the rear output plenum 16*b*, and pipes, not shown, are connected to this inlet and outlet so as to supply and exhaust fluid, for example refrigerant for an automobile air conditioner, or the like.

Therefore, during operation of the compressor described above as the shaft 6 and the swash plate 7 rotate and the six pumping chambers 14*a* through 14*f* expand and contract with the phases of their motions being 60° apart as explained above, fluid enters the inlet 32 and passes into the rear input plenum 15*b*. This flow then splits: approximately half of it proceeds through the rear input transfer aperture 21*b* and down the input transfer chamber 22 to pass from its front end via the front input transfer aperture 21*a* through the front valve plate 3*a* into the front input plenum 15*a*, and is then supplied to the three input orifices 17*a*, 17*b*, and 17*c* opening through the front valve plate 3*a* for the front pumping chambers 14*a*, 14*b*, and 14*c* (past the input valve means therefor, not shown), and thus is sucked into these front pumping chambers 14*a*, 14*b*, and 14*c* in turn as the pistons 11*a* through 11*c* reciprocate. Similarly, the other approximate half part of said flow is supplied directly from the rear input plenum 15*b* to the three input orifices 17*d*, 17*e*, and 17*f* opening through the rear valve plate 3*b* for the rear pumping chambers 14*d*, 14*e*, and 14*f* (also past the input valve means therefor, not shown), and thus is sucked into these rear pumping chambers 14*d*, 14*e*, and 14*f* in turn as the pistons 11*a* through 11*c* reciprocate.

Next, to describe the outlet side, with regard to the flow of the fluid which has been compressed within the rear pumping chambers 14*d*, 14*e*, and 14*f*, it is ejected therefrom directly into the rear output plenum 16*b*, through the rear output orifices 19*d*, 19*e*, and 19*f* formed in the front valve plate 3*a*, past the output valve means 18*d*, 18*e*, and 18*f* respectively. And the flows of the fluid which has been compressed within the front pumping chambers 14*a*, 14*b*, and 14*c* pass respectively through the front output orifices 19*a*, 19*b*, and 19*c* formed in the front valve plate 3*a*, past the output valve means 18*a*, 18*b*, and 18*c* respectively, into the front output plenum 16*a*, where they meld together into a front output fluid flow. This fluid flow then flows from said front output plenum 16*a* through the aforementioned front output transfer aperture (not shown) formed through the front valve plate 3*a*, into the front end of the output transfer passage (also not shown) defined between the pairs of cylinder bores 14*a*, 14*d* and 14*b*, 14*e* and axially extending right through the cylinder block 2, down along this output transfer passage to the rear end thereof, and through the rear output transfer aperture 42 formed in the rear valve plate 3*b* into the rear output plenum 16*b*, to become melded with the aforementioned three flows of fluid from the rear pumping chambers 14*d*, 14*e*, and 14*f* which have also passed into said rear output plenum 16*b*. Finally, these united output flows of all the six pumping chambers 14*a* through 14*f* pass out of the rear output plenum 16*b* through the fluid outlet (not shown) and into the output pipe (also not shown) connected thereto.

However, the problem with this structure is that, as the six pumping chambers 14*a* through 14*f* one after another in sequence suck in fluid through their respective input orifices 17*a* through 17*f* and expel fluid under pressure through their respective output orifices 19*a* through 19*f*, pressure pulsations are generated at the other sides both of these input and these output orifices. Such pressure pulsations are easily transmitted through the inlet 32 and the outlet (not shown) to the pipes connected thereto, and can cause problems with regard to noise and vibration. Such vibration can be very troublesome, possibly leading to deterioration of the mounting of the pipes and failure of the system to which the compressor is fitted.

SUMMARY OF THE INVENTION

Accordingly, it is the primary object of the present invention to provide an improvement to such a swash plate type compressor as described above, which avoids the above described problems.

It is a further object of the present invention to provide such an improvement to such a compressor, which reduces vibration and noise caused by input pulsations.

It is a further object of the present invention to provide such an improvement to such a compressor, which reduces vibration and noise caused by output pulsations.

It is a further object of the present invention to provide such an improvement to such a compressor, which makes the path to be taken by input pulsations longer and more tortuous than in the prior art.

It is a further object of the present invention to provide such an improvement to such a compressor, which makes the path to be taken by output pulsations longer and more tortuous than in the prior art.

It is a further object of the present invention to provide such an improvement to such a compressor, which results in a compact structure which does not use much space.

It is a further object of the present invention to provide such an improvement to such a compressor, which is economical with respect to the materials used in its manufacture.

It is a yet further object of the present invention to provide such an improvement to such a compressor, which is easy and cheap to manufacture.

It is a yet further object of the present invention to provide such an improvement to such a compressor, which promotes good and smooth fluid flow.

According to the most general aspect of the present invention, these and other objects are accomplished by, in a swash plate type compressor comprising: (a) a rotatable drive shaft; (b) a cylinder block assembly in which said drive shaft is rotatably mounted, said cylinder block assembly being formed with a plurality of pairs of cylinder bores, the two cylinder bores of each said pair being coaxial and axially opposed to one another, said pairs of cylinder bores extending parallel to said drive shaft and being disposed around said drive shaft; (c) a plurality of double headed pistons, one for each of said pairs of said cylinder bores, each of said pistons being slidably received by one of its heads in one of its said pair of said cylinder bores and by the other of its heads in the other cylinder bore of said pair; (d) a swash plate fixedly engaged with said drive shaft in an oblique orientation and slidably engaged with each of said pistons, so that said pistons are reciprocated as said drive shaft and said swash plate are rotated in said cylinder block assembly; (e) a first valve plate on a first end of said cylinder block assembly which closes the end of one cylinder bore of each of said pairs thereof to define a first set of cylinder chambers; (f) a second valve plate on a second end of said cylinder block assembly which closes the end of the other cylinder bore of each of said pairs thereof to define a second set of cylinder chambers; (g) a first end block secured to said first end of said cylinder block assembly and holding said first valve plate thereagainst, formed in a shape which in cooperation with said first valve plate defines a first input plenum and an output plenum; (h) first input valve means which communicates said first input plenum with each one of said first set of cylinder chambers when and only when said one of said first set of cylinder chambers is expanding; (i) first output valve means which communicates said output plenum with each one of said first set of cylinder chambers when and only when said one of said first set of cylinder chambers is contracting; and (j) a second end block at said second end of said cylinder block assembly, formed with an inlet and an outlet; the improvement comprising: (k) a partition plate secured to said second end of said cylinder block assembly between it and said second end block and holding said second valve plate against said second end of said cylinder block assembly, and having a shape which in cooperation with said second valve plate defines a second input plenum, and at least one output chamber; (l) second input valve means which communicates said second input plenum with each one of said second set of cylinder chambers when and only when said one of said second set of cylinder chambers is expanding; and (m) second output valve means which communicates said output chamber with a corresponding one of said second set of cylinder chambers when and only when said corresponding one of said second set of cylinder chambers is contracting; (n) said second end block having a shape which in cooperation with said partition plate defines an inlet buffering chamber to which said inlet opens and an outlet buffering chamber to which said outlet opens; (o) said cylinder block assembly having an input transfer passage extending between its two ends and communicated at its one end with said first input plenum and at its other end with said second input plenum; (p) said partition plate being provided with at least one output transfer aperture which communicates said output chamber to said outlet buffering chamber; said improvement further comprising: (q) a means for communicating said inlet buffering chamber to said input transfer passage.

According to such a structure, input pressure pulsations caused in the first input plenum by the pumping action of the first set of cylinder chambers are transmitted from said first input plenum into said one end of said input transfer passage, while on the other hand input pressure pulsations caused in the second input plenum by the pumping action of the second set of cylinder chambers are transmitted from said second input plenum into said other end of said input transfer passage, and these two set of input pressure pulsations merge in said input transfer passage and then pass, through said means for communicating from said inlet buffering chamber to said input transfer passage, into said inlet buffering chamber, whence they pass to said inlet. Because of having to travel through such a relatively long and tortuous path, as compared with the prior art described above in which no such chamber as the inlet buffering chamber was provided, and also because of the many variations in cross sectional area along this tortuous path, these input pressure pulsations are very well and effectively damped and attenuated, before they can pass through the inlet of the compressor to enter into an inlet pipe and create undesirable noise and vibration. Accordingly this compressor with this improvement can function much more quietly and steadily than the prior art compressor of FIGS. 4 and 5. And further, this lengthening and complication of the path for the input pressure pulsations, which has provided the good effects described above, has according to the present invention been provided as a very compact and efficient structure, merely by the addition of the appropriately configured partition plate to the structure of the prior art (along with appropriate configuration of the second end block), which does not involve any very great additional use of materials or manufacturing complexity, and does not use substantial extra mounting space or involve substantial additional cost.

Further, according to a more particular aspect of the present invention, these and other objects are more particularly and concretely accomplished by the improvement to a swash plate type compressor as defined above, wherein further: said partition plate in cooperation with said second valve plate defines the same number of output chambers as the number of said second set of cylinder chambers, and an output transfer chamber; said second output valve means communicates each one of said output chambers with a corresponding one of said second set of cylinder chambers when and only when said corresponding one of said second set of cylinder chambers is contracting; said cylinder block assembly is provided with an output transfer passage extending between its two ends and communicated at its one end to said output plenum and at its other end to said output transfer chamber; and said partition plate is formed with a plurality of output transfer apertures, the same in number as the number of said output chambers, each of which communicates one of said output chambers to said outlet buffering chamber, and with a combined output transfer aperture which communicates said output transfer chamber to said outlet buffering chamber.

According to such a structure, with regard to output pressure pulsations caused in the output plenum by the pumping action of the first set of cylinder chambers, they are transmitted from said output plenum into said one end of said output transfer passage, and are then transmitted down said output transfer passage, into said output transfer chamber, and then through said combined output transfer aperture into said outlet buffering chamber, while on the other hand output pressure pulsations caused in the multiple output chambers by the pumping action of the second set of cylinder chambers are transmitted from said output chambers through said output transfer apertures also into said outlet buffering chamber, and these two sets of output pressure pulsations merge in said output buffering chamber, whence they pass to said outlet. Again, therefore, because of having to travel through such a relatively long and tortuous path network, as compared with the prior art described above in which no such chambers as the output transfer chamber or the outlet buffering chamber were provided, and also because of the many variations in cross sectional area along this tortuous path network, these output pressure pulsations are very well and effectively damped and attenuated, before they can pass through the outlet of the compressor to enter into an outlet pipe and create undesirable noise and vibration. Accordingly, again, this compressor with this improvement can function much more quietly and steadily than the prior art compressor of FIGS. 4 and 5. And further, this lengthening and complication of the path for the output pressure pulsations, which has provided the good effects described above, again has according to the present invention been provided as a very compact and efficient structure, merely by the addition of the appropriately configured partition plate to the structure of the prior art (along with appropriate configuration of the second end block), which as described above does not involve any very great additional use of materials or manufacturing complexity, and does not use substantial extra mounting space or involve substantial additional cost.

Further, according to a more particular aspect of the present invention, these and other objects are more particularly and concretely accomplished by the improvement to a swash plate type compressor as proximately defined above, wherein further said plurality of output transfer apertures and said combined output transfer aperture provided in said partition plate open into said outlet buffering chamber all substantially equidistantly said outlet in said second end block.

According to such a structure, the flows out into said outlet buffering chamber from said plurality of output transfer apertures and said combined output transfer aperture all flow substantially directly to said outlet, not substantially interfering with one another. Accordingly smooth fluid flow is promoted.

BRIEF DESCRIPTION OF THE DRAWINGS

The present invention will now be described with reference to the drawings. It should be clearly understood, however, that the drawings are given for the purposes of explanation only, and are not intended to be limitative in any way, since the scope of the present invention is to be defined solely by the appended claims. In the drawings, like parts and spaces are denoted by like reference symbols in the various figures thereof, and:

DESCRIPTION OF THE PREFERRED EMBODIMENT

Figure 1:
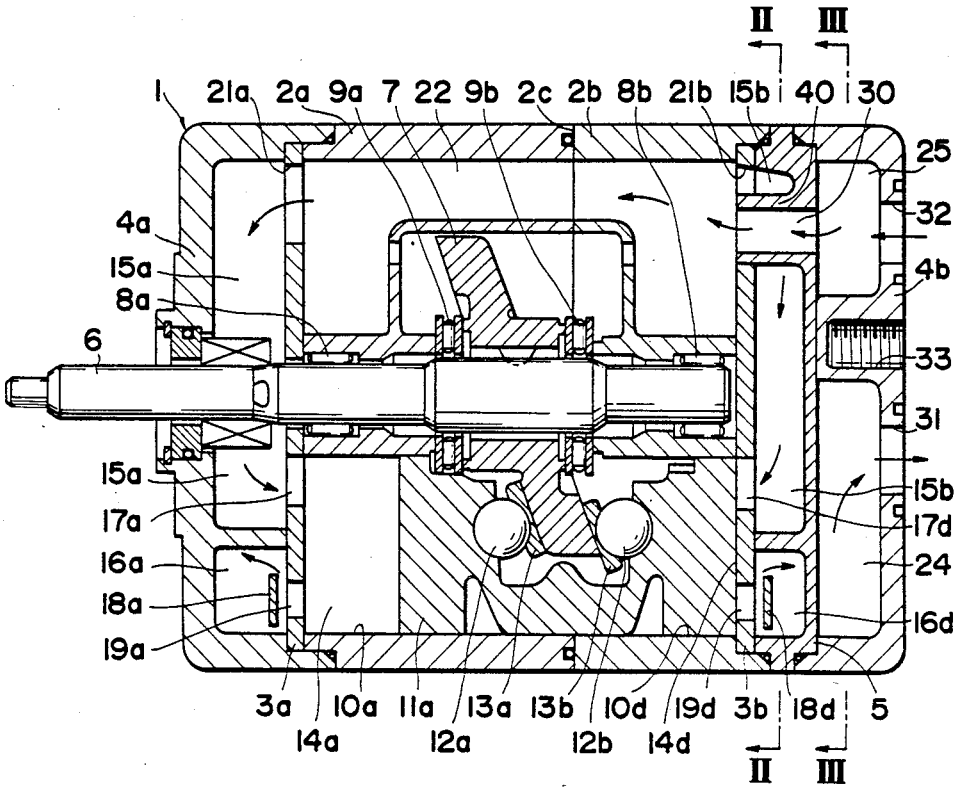
FIG. 1 is a longitudinal sectional view, taken in an angled plane, of a swash plate type compressor incorporating the preferred embodiment of the improvement according to the present invention.

The present invention will now be described with reference to the preferred embodiment thereof, and with reference to the appended drawings. FIG. 1 is a longitudinal sectional view of a compressor which incorporates the improvement according to the present invention in its preferred embodiment. In this figure, the reference numeral 1 denotes the body of the compressor as a whole; in the following the left hand end thereof in FIG. 1 will be referred to as its front end while its right hand end will be referred to as its rear end. The compressor body 1 is made up of two cylinder blocks *2a, 2b* made of a non magnetic material such as aluminum alloy and coaxially abutted together at a seam *2c,* two front and rear valve plates *3a, 3b* which are secured to the ends of the front and rear cylinder blocks 2a and 2b respectively, a partition plate 5 which is secured against the rear end of the rear cylinder block 2b so as to sandwich the rear valve plate 3b thereagainst and so as to define in cooperation therewith chambers as will be explained hereinafter, a front end block 4a which is secured to the front end of the front cylinder block 2a so as to sandwich the front valve plate 3a thereagainst and so as to define in cooperation therewith chambers as also will be explained hereinafter, and a rear end block 4b which is secured to the rear side of the partition plate 5 and so as to define in cooperation therewith chambers as also will be explained hereinafter.

Through the front end block 4a, the front valve plate 3a, and the front cylinder block 2a and into a journal formed in the rear cylinder block 2b, along their central axial line, there extends a shaft 6. This shaft 6 is rotatably mounted in the front and the rear cylinder blocks 2a and 2b by needle roller bearings 8a and 8b respectively, and is further prevented from axial movement by thrust needle roller bearings 9a and 9b respectively fitted between said shaft 6 and said front and rear cylinder blocks 2a and 2b. An obliquely angled swash plate 7 is fixedly mounted on the shaft 6 at the approximate axial center of the shaft 6 between the two valve plates 3a and 3b.

Each of the cylinder blocks 2a and 2b is provided with three respective cylinder bores 10a, 10b, 10c and 10d, 10e, 10f extending parallel to its central axis and arranged around it at positions 120° apart; only one of each of these sets of cylinder bores (10a and 10d) can be seen in FIG. 1 because the other two bores of each set (10b, 10c and 10e, 10f) lie out of the sectional plane of the drawing. In each of the cylinder blocks 2a and 2b, between these cylinder bores formed therein, there are further formed communication chambers and passages as will be described hereinafter. And the cylinder bores 10a and 10d, 10b and 10e, and 10c and 10f of the front and rear cylinder blocks 2a and 2b are coaxial and oppose one another.

In the cylinder bores 10a and 10d there is slidably fitted a double headed piston member 11a, in the cylinder bores 10b and 10e there is slidably fitted a double headed piston member 11b, and in the cylinder bores 10c and 10f there is slidably fitted a double headed piston member 11c; but only the piston member 11a can be seen in FIG. 1 because the other two piston members 11b and 11c lie out of the sectional plane of the drawing. A front pumping chamber 14a is defined between the front end of the piston member 11a and the front valve plate 3a, in cooperation with the front cylinder bore 10a; and a rear pumping chamber 14d is defined between the rear end of the piston member 11a and the rear valve plate 3b, in cooperation with the rear cylinder bore 10d. Similarly, a front pumping chamber 14b is defined between the front end of the piston member 11b and the front valve plate 3a, in cooperation with the front cylinder bore 10b, and a rear pumping chamber 14e is defined between the rear end of the piston member 11b and the rear valve plate 3b, in cooperation with the rear cylinder bore 10e; and a front pumping chamber 14c is defined between the front end of the piston member 11c and the front valve plate 3a, in cooperation with the front cylinder bore 10c, and a rear pumping chamber 14f is defined between the rear end of the piston member 11c and the rear valve plate 3b, in cooperation with the rear cylinder bore 10f; but these other four pumping chambers 14b, 14c, 14e, and 14f cannot be seen in FIG. 1 because they lie out of the sectional plane of the drawing. As seen in the sectional view presented in FIG. 1, the central part of the piston member 11a is cut away, and two balls 12a, 12b are mounted in the cutaway on opposite axial ends thereof; and via two shoe members 13a and 13b these balls 12a and 12b are engaged with the swash plate 7: thereby the piston member 11a is axially reciprocated to and fro in its cylinder bores 10a and 10d as the shaft 6 and the swash plate 7 are rotated. The arrangements relating to the other two piston members 11b and 11c are similar, but cannot be seen in the figures. Thereby, as the shaft 6 is rotated with the swash plate 7 being thereby wobblingly rotated, the three piston members 11a, 11b, and 11c are reciprocally driven to and fro in their cylinder bores, with the phases of their motion differing by 120° from one another; and the six pumping chambers 14a through 14f expand and contract, with the phases of their motion differing by 60° from one another, in an arrangement which will be easily understood based upon the foregoing description. Lubrication arrangements, which are not particularly shown, are provided for the balls 12a, 12b and the shoe members 13a and 13b and the needle bearings 8a, 8b, 9a, 9b and so on.

It should be understood that, although the present invention is herein being described in terms of its application to a compressor which has three pistons and six pumping chambers as described above, this is not intended to be limitative of the present invention, and it could be applied to compressors with other numbers of pistons and pumping chambers.

Each of the six pumping chambers 14a through 14f has extending through its defining valve plate 3a or 3b an input orifice, respectively denoted as 17a through 17f, and a similarly formed output orifice, respectively denoted as 19a through 19f; the input orifices 17a through 17f are on the sides of their ends of the pumping chambers 14a through 14f towards the central axis of the compressor, while the output orifices 19a through 19f are on the opposite sides of said ends, away from said central axis. Fluid flow through each of the output orifices 19a through 19f is controlled by a respective valve means 18a through 18f, only schematically shown in the figures, provided on the respective valve plate 3a or 3b on the outside of the respective pumping chamber 14a through 14f; this valve means 18a through 18f allows fluid to flow out of the respective pumping chamber 14a through 14f through the respective output orifice 19a through 19f, but not in the reverse direction. Similarly, fluid flow through each of the input orifices 17a through 17f is controlled by a valve means not shown in the figures; this valve means allows fluid to flow into the respective pumping chamber 14a through 14f through the respective input orifice 17a through 17f, but not in the reverse direction.

Now, the configurations of the front and the rear end blocks 4a and 4b and of the partition plate 5, along with the chambers and passages defined thereby and their interconnections, which relates to the gist of the present invention, will be explained. Each of these members is generally in a cup shape, and has one or more partition walls extending across it, so that in cooperation with the member to which it is fitted it defines certain compartments.

Figure 5:
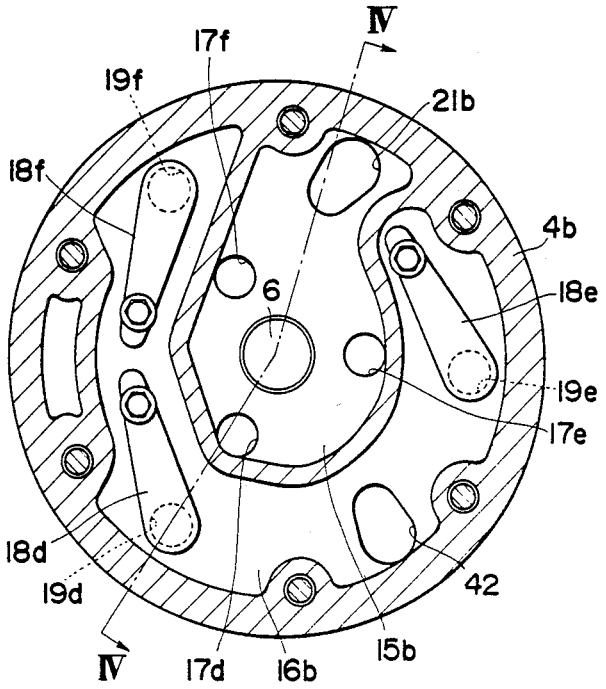
FIG. 5 PRIOR ART
FIG. 5 is a sectional view of the prior art compressor of FIG. 4 taken in a plane indicated by the arrows V—V in FIG. 4, with the angled sectional plane of FIG. 4 being shown by a single dotted line indicated by the arrows IV—IV.

The front end block 4a is shaped in a manner not specifically shown in any section thereof in the figures, but generally like the rear end block 4b of the prior art compressor shown in FIG. 5 and discussed above, and is generally cup shaped, having a circular rim which is abutted against the end of the front cylinder block 2*a* and an interior partition wall system so as to define a front input plenum 15*a* and a front output plenum 16*a* formed in a crescent shape surrounding said front input plenum 15*a*. The front input plenum 15*a* has the three input orifices 17*a*, 17*b*, and 17*c* of the front pumping chambers 14*a*, 14*b*, and 14*c* opening through the front valve plate 3*a* into it, and also a front input transfer aperture 21*a* opens through the front valve plate 3*a* into said front input plenum 15*a*. Similarly, the front output plenum 16*a* has the three output orifices 19*a*, 19*b*, and 19*c* of the front pumping chambers 14*a*, 14*b*, and 14*c* opening through the front valve plate 3*a* into it, and also a front output transfer aperture not shown in the figures opens through the front valve plate 3*a* into said front output plenum 16*a*.

In the cylinder block 2 (i.e. the combination of the front and rear cylinder blocks 2*a* and 2*b*) between the pairs of cylinder bores 14*b*, 14*e* and 14*c*, 14*f* there is defined an input transfer chamber 22 extending right through the cylinder block 2 and communicating to the front input plenum 15*a* via the front input transfer aperture 21*a* through the front valve plate 3*a* at its front end; and similarly between the pairs of cylinder bores 14*a*, 14*d* and 14*b*, 14*e* there is defined an output transfer passage extending right through the cylinder block 2 and communicating at its front end to the front output plenum 16*a* via the aforementioned front output transfer aperture formed through the front valve plate 3*a*, but none of these arrangements can be seen in the figures.

Figure 2:
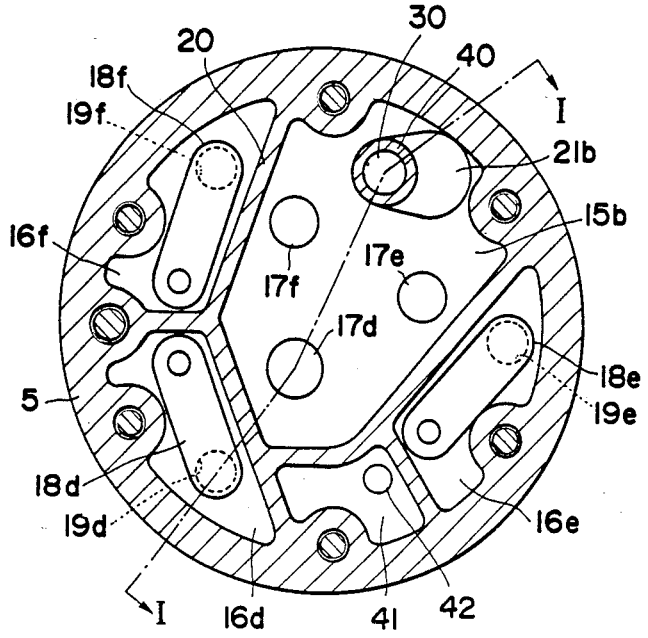
FIG. 2 is a sectional view of a partition plate of the compressor of FIG. 1 taken in a plane indicated by the arrows II—II in FIG. 1 and looking towards a rear valve plate, with the angled sectional plane of FIG. 1 being shown by a single dotted line indicated by the arrows I—I.

Now, referring to FIG. 2, there is shown therein a transverse cross section of the partition plate 5 taken in a plane indicated by the arrows II—II in FIG. 1 and looking towards the rear valve plate 3*b*, with the angled sectional plane of FIG. 1 being shown by the single dotted line indicated by the arrows I—I. The partition plate 5 is generally cup shaped, having a circular rim which is abutted against the end of the rear cylinder block 2*b*, and an interior partition wall system 20 which defines five chambers: a rear input plenum 15*b*, three rear output chambers 16*d*, 16*e*, and 16*f*, and an output transfer chamber 41. The rear input plenum 15*b* has the three input orifices 17*d*, 17*e*, and 17*f* of the rear pumping chambers 14*d*, 14*e*, and 14*f* opening through the rear valve plate 3*b* into it, and also a rear input transfer aperture 21*b* opens through the rear valve plate 3*b* from the input transfer chamber 22 into said rear input plenum 15*b*. Further, a boss 40 is formed in the partition plate 5 extending from its rear side to project just through this rear input transfer aperture 21*b* through the rear valve plate 3*b* (see FIG. 1), said boss 40 occupying only a part of the aperture 21*b*, and an input transfer passage 30 is formed through this boss 40 so as to open into the input transfer chamber 22. The three rear output chambers 16*d*, 16*e*, and 16*f* have respectively the three rear output orifices 19*d*, 19*e*, and 19*f* of the rear pumping chambers 14*d*, 14*e*, and 14*f* opening through the rear valve plate 3*b* into them, and also a rear output transfer aperture 42 opens through the rear valve plate 3*b* into the output transfer chamber 41; this rear output transfer aperture 42 is communicated on its other side to the rear end of the aforementioned output transfer passage extending right through the cylinder block 2 and not shown in the figures.

Figure 3:
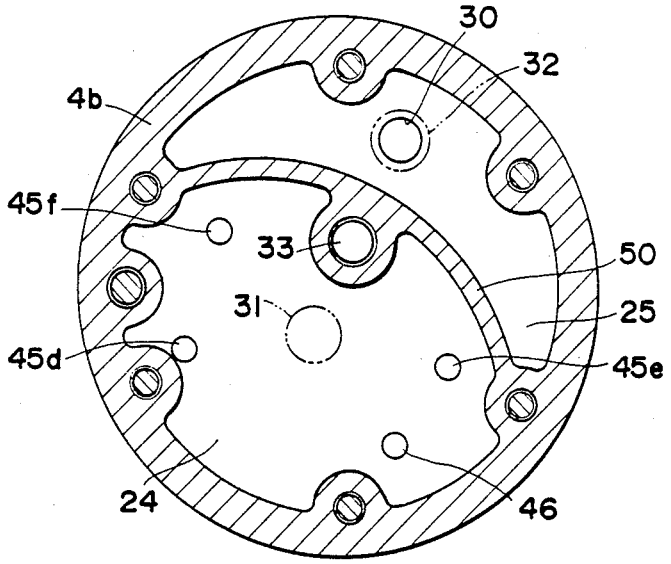
FIG. 3 is a sectional view of a rear end block of the compressor of FIG. 1 taken in a plane indicated by the arrows III—III in FIG. 1 and looking towards said partition plate.

Finally, referring to FIG. 3, there is shown therein a transverse cross section of the rear end block 4*b* taken in a plane indicated by the arrows III—III in FIG. 1 and looking towards the partition plate 5. The rear end block 4*b* is generally cup shaped, having a circular rim which is abutted against the rear side of the partition plate 5, and an interior partition wall 50 which defines two chambers: a crescent shaped input buffering chamber 25 and a gibbous shaped output buffering chamber 24. As best seen in FIG. 1, into the input buffering chamber 25 there opens a fluid inlet 32 (coaxial with the input transfer passage 30 and the boss 40), and into the output buffering chamber 24 there opens a fluid outlet 31. Also a boss 33 is formed in the rear end block 4*b* and is provided with a screw thread for supporting a screw for holding a bracket, not shown, which during use of the compressor steadies inlet and outlet tubes, also not shown, connected for supply and removal of fluid to the fluid inlet 32 and the fluid outlet 31. FIG. 3 also shows the aperture 30 through the boss 40, which leads from the input buffering chamber 25 into the input transfer chamber 22, and also shows four apertures 45*d*, 45*e*, 45*f*, and 46 through the rear side of the partition plate 5. These apertures 45*d* through 45*f* and 46 are symmetrically located with respect to the fluid outlet 31 and are equidistant therefrom. The aperture 45*d* opens from the rear output chamber 16*d* to which the rear output orifice 19*d* of the rear pumping chamber 14*d* opens, and similarly the aperture 45*e* opens from the rear output chamber 16*e* to which the rear output orifice 19*e* of the second rear pumping chamber 14*e* opens and the aperture 45*f* opens from the rear output chamber 16*f* to which the rear output orifice 19*f* of the third rear pumping chamber 14*f* opens; while on the other hand the aperture 46 opens to the output transfer chamber 41 into which the rear output transfer aperture 42 is open from the rear end of the aforementioned output transfer passage extending right through the cylinder block 2.

The flow of fluid (refrigerant gas) through these passages and chambers, during operation of the compressor described above as the shaft 6 and the swash plate 7 rotate and the three front pumping chambers 14*a* through 14*c* and the three rear pumping chambers 14*d* through 14*f* expand and contract with the phases of their motions being 60° apart as explained above, occurs as follows.

First, to describe the inlet side, fluid from the inlet pipe, not shown, connected to the fluid inlet 32 enters it and passes into the input buffering chamber 25. Thence, it passes through the aperture 30 through the boss 40, and is ejected just inside the rear end of the input transfer chamber 22, as schematically shown by the flow arrows in FIG. 1. This flow then splits: approximately half of it proceeds down the input transfer chamber 22 to pass from its front end via the front input transfer aperture 21*a* through the front valve plate 3*a* into the front input plenum 15*a*, while the other approximate half part of said flow passes from the rear end of the input transfer chamber 22 via the rear input transfer aperture 21*b* through the rear valve plate 3*b* (around the boss 40) into the rear input plenum 15*b*, as again schematically shown in FIG. 1 by the flow arrow. The flow into the front input plenum 15*a* is thus supplied to the three input orifices 17*a*, 17*b*, and 17*c* opening through the front valve plate 3*a* for the front pumping chambers 14*a*, 14*b*, and 14*c* (past the input valve means therefor, not shown), and thus is sucked into these front pumping chambers 14*a*, 14*b*, and 14*c* in turn as the pistons 11*a* through 11*c* reciprocate. Similarly, the flow into the rear input plenum 15*b* is then supplied to the three input orifices 17*d*, 17*e*, and 17*f* opening through the rear valve plate 3*b* for the rear pumping chambers 14*d*, 14*e*, and 14*f* (also past the input valve means therefor, not shown), and thus is sucked into these rear pumping chambers 14*d*, 14*e*, and 14*f* in turn as the pistons 11*a* through 11*c* reciprocate.

Next, to describe the outlet side, first the flow of the fluid which has been compressed within the rear pumping chambers 14*d*, 14*e*, and 14*f* will be described. Fluid compressed within the pumping chamber 14*d* by the piston 11*a* is ejected therefrom through the rear output orifice 19*d* formed in the rear valve plate 3*b* past the output valve means 18*d* into the rear output chamber 16*d*, and flows therefrom through the aperture 45*d* into the output buffering chamber 24. Similarly, fluid compressed within the pumping chamber 14*e* by the piston 11*b* is ejected therefrom through the rear output orifice 19*e* formed in the rear valve plate 3*b* past the output valve means 18*e* into the rear output chamber 16*e*, and flows therefrom through the aperture 45*e* into the output buffering chamber 24, and also fluid compressed within the pumping chamber 14*f* by the piston 11*c* is ejected therefrom through the rear output orifice 19*f* formed in the rear valve plate 3*b* past the output valve means 18*f* into the rear output chamber 16*f*, and flows therefrom through the aperture 45*f* also into the output buffering chamber 24. Next, to consider the flows of the fluid which has been compressed within the front pumping chambers 14*a*, 14*b*, and 14*c*, these flows pass respectively through the front output orifices 19*a*, 19*b*, and 19*c* formed in the front valve plate 3*a*, past the output valve means 18*a*, 18*b*, and 18*c* respectively, into the front output plenum 16*a*, where they meld together into a front output fluid flow. This fluid flow then flows from said front output plenum 16*a* through the aforementioned front output transfer aperture (not shown) formed through the front valve plate 3*a*, into the front end of the output transfer passage (also not shown) defined between the pairs of cylinder bores 14*a*, 14*d* and 14*b*, 14*e* and axially extending right through the cylinder block 2, down along this output transfer passage to the rear end thereof, and through the rear output transfer aperture 42 formed in the rear valve plate 3*b* into the output transfer chamber 41 defined within the partition plate 5 (see FIG. 2). From this output transfer chamber 41, this melded fluid flow from the three front pumping chambers 14*a*, 14*b*, and 14*c* passes through the aperture 46 formed in the back side of the partition plate 2 into the output buffering chamber 24, to become melded with the aforementioned three flows of fluid from the rear pumping chambers 14*d*, 14*e*, and 14*f* which have respectively passed through the apertures 45*d*, 45*e*, and 45*f* into said output buffering chamber 24. Finally, these united output flows of all the six pumping chambers 14*a* through 14*f* pass out of the output buffering chamber 24 through the fluid outlet 31 and into the output pipe, not shown, connected thereto.

Figure 4:
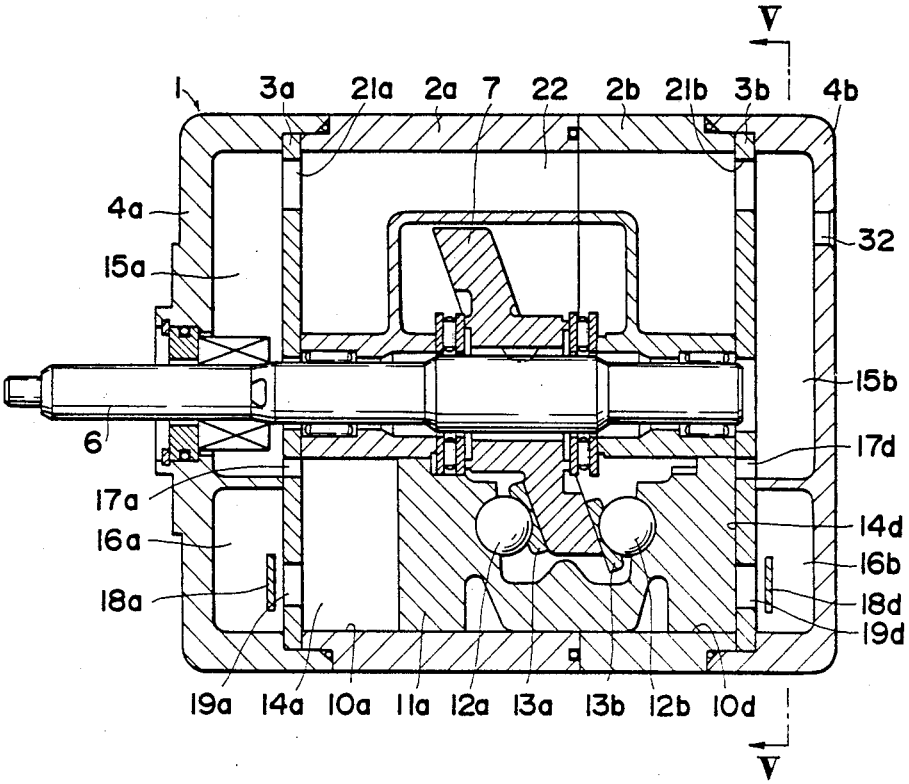
FIG. 4 PRIOR ART
FIG. 4 is a longitudinal sectional view, similar to the view given in FIG. 1 of the compressor improved according to the present invention, showing a swash plate type compressor of a prior art type.

Now, as has been explained with reference to the prior art form of compressor shown in FIGS. 4 and 5, naturally as the six pumping chambers 14*a* through 14*f* one after another in sequence suck in fluid through their respective input orifices 17*a* through 17*f* pressure pulsations are generated at the other sides of these input orifices. However, with regard to the pressure pulsations generated by the three front pumping chambers 14*a* through 14*c*, first they are combined in the front input plenum 15*a*, then they are transmitted through the front input transfer aperture 21*a* through the front valve plate 3*a* to the input transfer chamber 22, and then these pressure pulsations are transmitted along the input transfer chamber 22 (which is as large a volume as practicable in order to attenuate them and particularly is made of larger cross sectional area than the front and rear input transfer apertures 21*a* and 21*b* to the same end) from its front portion to its rear portion, and are further transmitted through the aperture 30 through the boss 40 into the input buffering chamber 25. Meanwhile, with regard to the pressure pulsations generated by the three rear pumping chambers 14*d* through 14*f*, first they are combined in the rear input plenum 15*b*, then they are transmitted through the rear input transfer aperture 21*b* through the rear valve plate 3*a* past the side of the boss 40 to the rear end portion of the input transfer chamber 22, to become blended with the aforemetnioned pressure pulsations generated by the three front pumping chambers 14*a* through 14*c*, and to pass through the aperture 30 through the boss 40 into the input buffering chamber 25. In this input buffering chamber 25, all these pulsations blend together and are attenuated, before being able to enter into the inlet 32 to pass into the inlet pipe and generate noise and vibration. Accordingly, due to the provision of the input buffering chamber 25, because as compared with the prior art form of compressor shown in FIGS. 4 and 5 the transmission distance to the inlet 32 for the input pressure pulsations is longer, and also because the cross sectional area of the transmission path is more varied, therefore these pressure pulsations are much better attenuated, and accordingly the shown compressor with the improvement according to the preferred embodiment of the present invention functions with much less noise and vibration being produced by input pulsations.

Further, with regard to ouput pulsations, as has also been explained with reference to the prior art form of compressor shown in FIGS. 4 and 5, naturally as the six pumping chambers 14*a* through 14*f* one after another in sequence squirt out pressurized fluid through their respective output orifices 19*a* through 19*f* pressure pulsations are generated at the other sides of these output orifices. However, with regard to the pressure pulsations generated by the three front pumping chambers 14*a* through 14*c*, first they are combined in the front output plenum 16*a*, then they are transmitted through the front output transfer aperture (not shown) through the front valve plate 3*a* to the front end of the output transfer passage (also not shown) extending right through the cylinder block 2 and then these pressure pulsations are transmitted along said output transfer passage from its front portion to its rear portion, and are further transmitted through the rear output transfer aperture 42 through the rear valve plate 3*b* into the output transfer chamber 41, whence they pass through the aperture 46 into the output buffering chamber 24. Meanwhile, with regard to the output pressure pulsations generated by the rear pumping chamber 14*d*, first they pass into the respective rear output chamber 16*d*, and then they are transmitted through the aperture 45*d* into said output buffering chamber 24. Similarly, the output pressure pulsations generated by the rear pumping chamber 14*e* first pass into the respective rear output chamber 16*e* and then are transmitted through the aperture 45*e* into said output buffering chamber 24, and also the output pressure pulsations generated by the rear pumping chamber 14*f* first pass into the respective rear output chamber 16*f* and then are transmitted through the aperture 45*f* into said output buffering chamber 24. Thus, the output pressure pulsations generated by the three rear pumping chambers 14*d* through 14*f* pass into the output buffering chamber 24 through the three apertures 45*d* through 45*f* which are substantially equidistant from the outlet 31, to become blended and melded in said output buffering chamber 24 with the output pressure pulsations generated by the three front pumping chambers 14*a* through 14*c* which are passing into said output buffering chamber 24 through the aperture 46 which is also at substantially the same distance from the outlet 31. Thus, in this output buffering chamber 25, all these output pulsations blend together and are attenuated, before being able to enter into the outlet 31 to pass into the outlet pipe and generate noise and vibration. Accordingly, due to the provision of the output buffering chamber 24, because as compared with the prior art form of compressor shown in FIGS. 4 and 5 the transmission distance to the outlet 31 for the output pressure pulsations is longer, and also because the cross sectional area of the transmission path is more varied, therefore these output pressure pulsations are much better attenuated, and accordingly the shown compressor with the improvement according to the preferred embodiment of the present invention functions with much less noise and vibration being produced by output pulsations.

Also, because the rear output transfer aperture 42 through the rear valve plate 3*b* leading from the output transfer passage (not shown) into the output transfer chamber 41 is intentionally made much smaller in cross sectional area than the output transfer chamber 41, thereby the pressure the compressed fluid can be decreased as it passes into this output transfer chamber 41, thus further attenuating pulsations therein and encouraging smooth fluid flow. Yet further, because the four apertures 45*d*, 45*e*, 45*f*, and 46 are all located at substantially the same distance from the outlet 31 in the output buffering chamber 24, as a consequence the flows of output pressurized fluid from, respectively, the rear pumping chamber 14*d*, the rear pumping chamber 14*e*, the rear pumping chamber 14*f*, and the three front pumping chambers 14*a* through 14*c*, do not interfere with one another, as they flow towards said outlet 31. Accordingly, again, smooth fluid flowing is promoted, and vibration and noise are minimized.

Although the present invention has been shown and described with reference to the preferred embodiment thereof, and in terms of the illustrative drawings, it should not be considered as limited thereby.

What is claimed is:

1. In a swash plate type compressor having:

(a) a rotatable drive shaft;

(b) a cylinder block assembly in which said drive shaft is rotatably mounted, said cylinder block assembly having a plurality of pairs of cylinder bores, the two cylinder bores of each said pair being coaxial and axially opposed to one another, said pairs fo cylinder bores extending parallel to said drive shaft and being disposed around said drive shaft;

(c) a plurality of double headed pistons, one for each of said pairs of said cylinder bores, each of said pistons having one of its heads slidably received in one of the corresponding pair of said cylinder bores and the other of its heads slidably received in the other cylinder bore of said pair;

(d) a swash plate fixedly mounted on said drive shaft in an oblique orientation and slidably engaged with each of said pistons, so that said pistons are reciprocated as said drive shaft and said swash plate are rotated in said cylinder block assembly;

(e) a first valve plate on a first end of said cylinder block assembly which closes the end of one cylinder bore of each of said pairs thereof to define a first set of cylinder chambers;

(f) a second valve plate on a second end of said cylinder block assembly which closes the end of the other cylinder bore of each of said pairs thereof to define a second set of cylinder chambers;

(g) a first end block secured to said first end of said cylinder block assembly and holding said first valve plate thereagainst, and having a shape which in cooperating with said first valve plate defines a first input plenum and an output plenum;

(h) first input valve means which communicates said first input plenum with each one of said first set of cylinder chambers when and only when said one of said first set of cylinder chambers is expanding;

(i) first output valve means which communicates said output plenum with each one of said first set of cylinder chambers when and only when said one of said first set of cylinder chambers is contracting; and (j) a second end block at said second end of said cylinder block assembly, and having therein an inlet and an outlet;

the improvement comprising:

(k) a partition plate secured to said second end of said cylinder block assembly between said second end and said second end block and holding said second valve plate against said second end of said cylinder block assembly, and having a shape which in cooperation with said second valve plate defines a second input plenum and at least one output chamber;

(l) second input valve means which communicates said second input plenum with each one of said second set of cylinder chambers when and only when said one of said second set of cylinder chambers is expanding;

(m) second output valve means which communicates said output chamber with a corresponding one of said second set of cylinder chambers when and only when said corresponding one of said second set of cylinder chambers is contracting;

(n) said second end block being having a shape which in cooperation with said partition plate defines an inlet buffering chamber into which said inlet opens and an outlet buffering chamber into which said outlet opens;

(o) said cylinder block assembly having an input transfer passage extending between its two ends and communicated at its one end with said first input plenum and at its other end with said second input plenum;

(p) said partition plate having at least one output transfer aperture which communicates said output chamber to said outlet buffering chamber; and (q) a means for communicating said inlet buffering chamber to said input transfer passage constituted by a boss integral with said partition plate and having a through hole therethrough, said boss projecting into said input transfer passage and one end of said through hole opening into said inlet buffering chamber and the other end of said through hole opening into said input transfer passage.

2. The improvement as defined in claim 1, wherein said partition plate in cooperation with said second valve plate defines the same number of output chambers as the number of said second set of cylinder chambers, and an output transfer chamber; said second output valve means communicates each one of said output chambers with a corresponding one of said second set of cylinder chambers when said only when said corresponding one of said second set of cylinder chambers is contracting; said cylinder block assembly having an output transfer passage extending between its two ends and communicated at its one end with said output plenum and at its other end with said output transfer chamber; and said partition plate has a plurality of output transfer apertures, the same in number as the number of said output chambers, each of which communicates one of said output chambers with said outlet buffering chamber, and a combined output transfer aperture which communicates said output transfer chamber with said outlet buffering chamber.

3. The improvement as defined in claim 2, wherein said plurality of output transfer apertures and said combined output transfer aperture in said partition plate all open into said outlet buffering chamber substantially equidistantly from said outlet in said second end block.

4. The improvement to as defined in claim 1 wherein said other end of said through hole opens into said other end of said input transfer passage.

5. The improvement to as defined in claim 4, wherein said other end of said input transfer passage is communicated with said second input plenum around the side of said boss.

* * * * *